US011725904B2

(12) United States Patent
Lee et al.

(10) Patent No.: US 11,725,904 B2
(45) Date of Patent: Aug. 15, 2023

(54) FIREARM HANDGUARD WITH BRIDGE ADAPTER

(71) Applicant: Strike IP, LLC, Las Vegas, NV (US)

(72) Inventors: Shanyao Lee, Santa Ana, CA (US); Hung-Ju Lee, Santa Ana, CA (US)

(73) Assignee: Strike IP, LLC, Las Vegas, NV (US)

( * ) Notice: Subject to any disclaimer, the term of this patent is extended or adjusted under 35 U.S.C. 154(b) by 66 days.

(21) Appl. No.: 17/534,041

(22) Filed: Nov. 23, 2021

(65) Prior Publication Data

US 2023/0160658 A1 May 25, 2023

(51) Int. Cl.
*F41C 23/16* (2006.01)
*F41C 23/18* (2006.01)

(52) U.S. Cl.
CPC ..... *F41C 23/16* (2013.01); *F41C 23/18* (2013.01)

(58) Field of Classification Search
CPC ..... F41C 23/16; F41C 23/18
See application file for complete search history.

(56) References Cited

U.S. PATENT DOCUMENTS 8,726,559 B1 * 5/2014 Mueller ..... F41A 21/482 42/75.02
8,739,448 B2 * 6/2014 Kimmel ..... F41C 23/16 42/72
8,806,793 B2 * 8/2014 Daniel ..... F41C 23/16 42/75.01
8,863,426 B1 * 10/2014 Zinsner ..... F41C 23/16 42/75.01
9,212,865 B2 * 12/2015 Dubreuil ..... F41C 23/16
9,464,865 B2 * 10/2016 Shea ..... F41C 23/16
9,476,672 B2 * 10/2016 Wells ..... F41G 11/003
9,476,673 B2 * 10/2016 Miller ..... F16B 39/04
9,557,137 B2 * 1/2017 Dzwill ..... F41A 21/48
9,841,248 B2 * 12/2017 Bybee ..... F41C 23/16
10,030,930 B2 * 7/2018 Hill ..... F41A 21/482
10,066,897 B2 * 9/2018 Hwang ..... F41A 21/48
10,101,104 B2 * 10/2018 Zheng ..... F41A 5/28
10,436,549 B1 * 10/2019 Taylor ..... F41C 23/16
10,591,247 B2 * 3/2020 Hubbell ..... F41G 11/003
10,619,971 B2 * 4/2020 Hubbell ..... F41C 23/16
10,641,568 B2 * 5/2020 Zinsner ..... F41G 11/003
10,724,825 B2 * 7/2020 Keeney ..... F41C 23/16
10,739,107 B2 * 8/2020 Drake ..... F41C 27/00
10,775,129 B1 * 9/2020 Kincel ..... F41C 23/16
10,809,038 B2 * 10/2020 Geissele ..... F41C 23/16
10,935,343 B2 * 3/2021 Chin ..... F41A 11/00
11,029,117 B2 * 6/2021 Tubb ..... F41A 21/48
11,193,730 B2 * 12/2021 Becklin ..... F41C 23/16
11,248,874 B2 * 2/2022 Kincel ..... F41A 21/48
11,326,853 B2 * 5/2022 Zinsner ..... F41A 21/48
11,371,802 B2 * 6/2022 Liao ..... F41A 21/48
(Continued)

*Primary Examiner* — Michelle Clement
(74) *Attorney, Agent, or Firm* — Han IP PLLC; Andy M. Han

(57) ABSTRACT

A apparatus implementable on a firearm includes a handguard assembly which is configured to at least partially surround a barrel of the firearm when the handguard is installed on the firearm. The handguard includes at least first and second physical features such that: (a) the first physical feature is configured to accommodate mounting of an accessory of the firearm on the handguard, and (b) the second physical feature is configured to secure a cable of the accessory onto the handguard.

20 Claims, 5 Drawing Sheets

(56) References Cited

U.S. PATENT DOCUMENTS

| | | | | |
|---|---|---|---|---|
| 11,391,532 | B2 * | 7/2022 | Markut | F41C 23/16 |
| 11,408,696 | B2 * | 8/2022 | Gerlings | F41A 5/28 |
| 11,598,595 | B2 * | 3/2023 | Wall | F41A 3/66 |
| 2011/0126443 | A1 * | 6/2011 | Sirois | F41C 23/16 42/90 |
| 2017/0299326 | A1 * | 10/2017 | Seekins | F41A 21/482 |
| 2018/0202757 | A1 * | 7/2018 | Samson | F41A 21/48 |
| 2022/0018629 | A1 * | 1/2022 | Senff | F41A 21/482 |
| 2022/0128331 | A1 * | 4/2022 | Kincel | F41A 21/48 |
| 2022/0252374 | A1 * | 8/2022 | Louthan | F41C 23/16 |
| 2022/0260335 | A1 * | 8/2022 | Williams | F41G 11/003 |
| 2022/0282951 | A1 * | 9/2022 | Wiggins | F41C 23/16 |
| 2022/0404119 | A1 * | 12/2022 | Zinsner | F41A 21/487 |

* cited by examiner

FIREARM HANDGUARD WITH BRIDGE ADAPTER

TECHNICAL FIELD

The present disclosure is generally related to firearms and, more particularly, to a handguard with a bridge adapter for firearms.

BACKGROUND

Unless otherwise indicated herein, approaches described in this section are not prior art to the claims listed below and are not admitted as prior art by inclusion in this section.

A handguard (also known as forend or forearm) on a firearm refers to a guard attached to the front portion of the firearm to shield or otherwise protect a user from the barrel of the firearm, which can become very hot when firing. On an AR-style or AK-style firearm, whether a rifle, carbine or pistol, the handguard is typically secured on a barrel nut of the firearm by either screws or another locking mechanism which requires tools to operate. With the handguard installed, the barrel of the AR-style or AK-style firearm (which typically includes a gas block, a gas tube or a piston system) is at least partially surrounded by and shielded inside the handguard.

However, as different AR-style and AK-style firearms manufactured by different vendors may have different dimensions and/or form factors, not all components are interchangeable from one AR-style/AK-style firearm to another. Take the AK-style firearms as an example, although Russian-made AKs and Romanian-make AKs may look similar, their receiver dimensions in width, height and length are actually different. As such, while an aftermarket handguard can fit on a first AK-style firearm, it might not fit on a second AK-style firearm even though both AK-style firearms may have similar appearances. It would be cost prohibitive for a firearm manufacturer to have different designs and produce many different versions and variations of handguard with different dimensions for the different variations of AK-style firearms on the market and in existence. Therefore, there is need for a solution of a firearm handguard with a bridge adapter that allows one handguard to fit on different AR-style/AK-style firearms that have receivers with different dimensions.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide an innovative design of a firearm handguard with a bridge adapter. It is believed that a firearm handguard with bridge adapter under various proposed schemes of the present disclosure may address or otherwise alleviate the aforementioned issues.

In one aspect, a device implementable on a plurality of firearms may include a handguard and at least first and second adapters. The handguard may be of a fixed size. The first and second adapters may have different sizes and each may be configured to couple between the handguard and a receiver of a respective one of at least two different firearms of the plurality of firearms having receivers of different dimensions.

In another aspect, a device implementable on a plurality of firearms may include a handguard and a plurality of adapters. The handguard may be configured to at least partially surround a barrel of each firearm of the plurality of firearms when the device is installed on a respective firearm of the plurality of firearms. Each adapter of the plurality of adapters may have a first side configured to connect to the handguard and a second side configured to connect to a receiver of the respective firearm when the device is installed on the respective firearm such that: (a) a first adapter of the plurality of adapters is configured to connect between the handguard and a first firearm of the plurality of firearms having a first receiver with first dimensions, and (b) a second adapter of the plurality of adapters is configured to connect between the handguard and a second firearm of the plurality of firearms having a second receiver with second dimensions that are different from the first dimensions.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
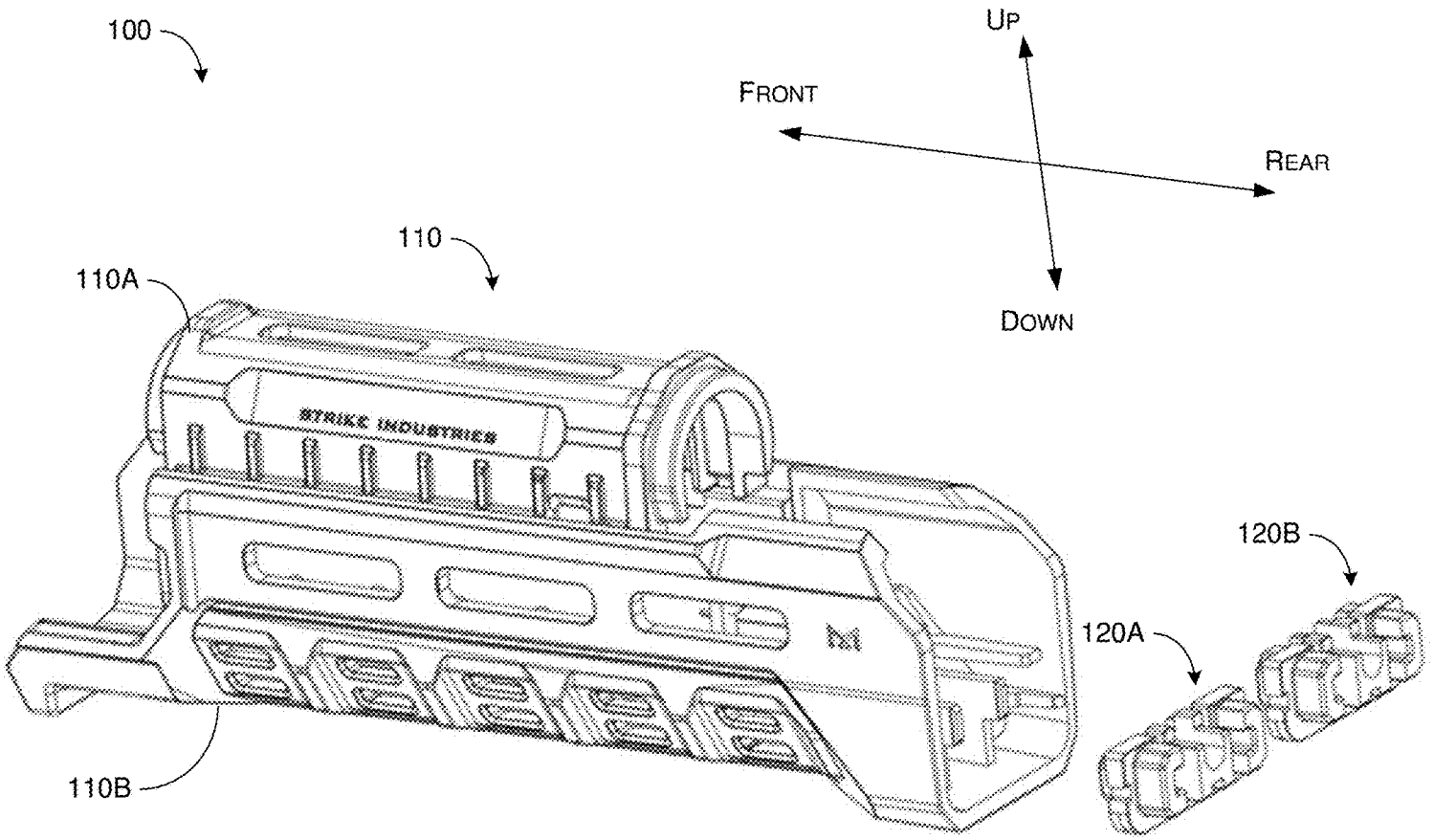
FIG. 1 is a diagram of a device implementable on different firearms in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

The following description is provided with reference to FIG. 1~FIG. 5 regarding a device 100 implementable on a firearm 200, which may be an AR-style firearm or an AK-style firearm, whether a rifle, carbine, pistol or shotgun.

Referring to FIG. 1, device 100 may include a handguard 100. In some implementations, handguard 100 may be comprised of an upper handguard portion 110A and a lower handguard portion 1108 each configured to at least partially surround a barrel of most firearms equipped with a handguard (e.g., firearm 200, which may be an AR-style or AK-style firearm or another type of firearm with a handguard) when the device 100 is installed on the firearm 200. The handguard 110 may be of a fixed size (e.g., a standard fixed size) and may be implemented, mounted or otherwise installed on a plurality of firearms which may be most firearms available on the market with a handguard, including the AR-style and/or AK-style firearms, that have receivers (to which the barrel of the firearm is attached, also known as upper receivers in the context of AR-style firearms) of different dimensions and/or sizes.

Device 100 may also include a plurality of bridge adapters (herein interchangeably referred to as "adapters") including at least a first bridge adapter 120A and a second bridge adapter 120B (herein interchangeably referred to as "first adapter 120A" and "second adapter 120B", respectively). The first and second bridge adapters 120A and 120B may have different sizes, and each of first and second bridge adapters 120A and 120B may be configured to couple between the handguard 110 and a receiver of a respective one of at least two different firearms of the plurality of firearms having receivers of different dimensions.

Figure 2:
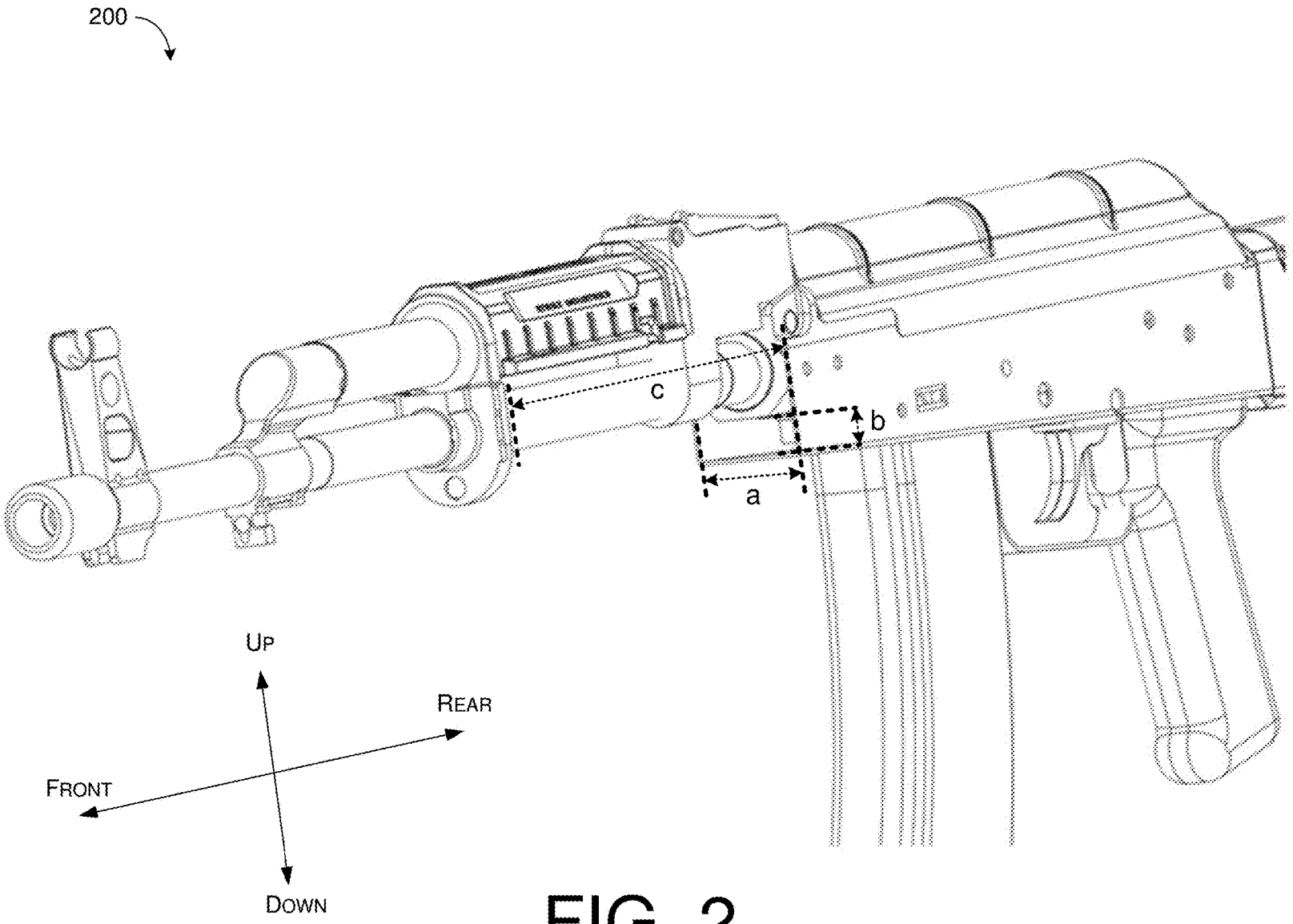
FIG. 2 is a diagram of an example firearm on which the device of FIG. 1 may be implemented.

Referring to FIG. 2, the receiver dimensions in concern on a receiver of a firearm (e.g., an AR-style or AK-style firearm) on which device 100 may be implemented are labeled as dimensions 'a', 'b' and 'c' to denote a width, height and length that may vary between different firearms (e.g., between Russian-made AKs and Romanian-make AKs). With device 100, handguard 110 may fit on different AR-style and AK-style firearms due to a bridge adapter (e.g., bridge adapter 120A/120B) coupled between handguard 110 and the receiver of the firearm. For instance, one side of the bridge adapter may be received in a recess, opening or physical feature on the receiver of the firearm, while the opposite side of the bridge adapter may be received in a recess or opening on handguard 110. A user of the firearm may choose a bridge adapter of a suitable size from a plurality of bridge adapters of different sizes to fit on a respective firearm. That is, with the availability of bridge adapters of different sizes, handguard 110 may be installed on different firearms (e.g., different AK variations) having different dimensions 'a', 'b' and 'c'.

Figure 3:
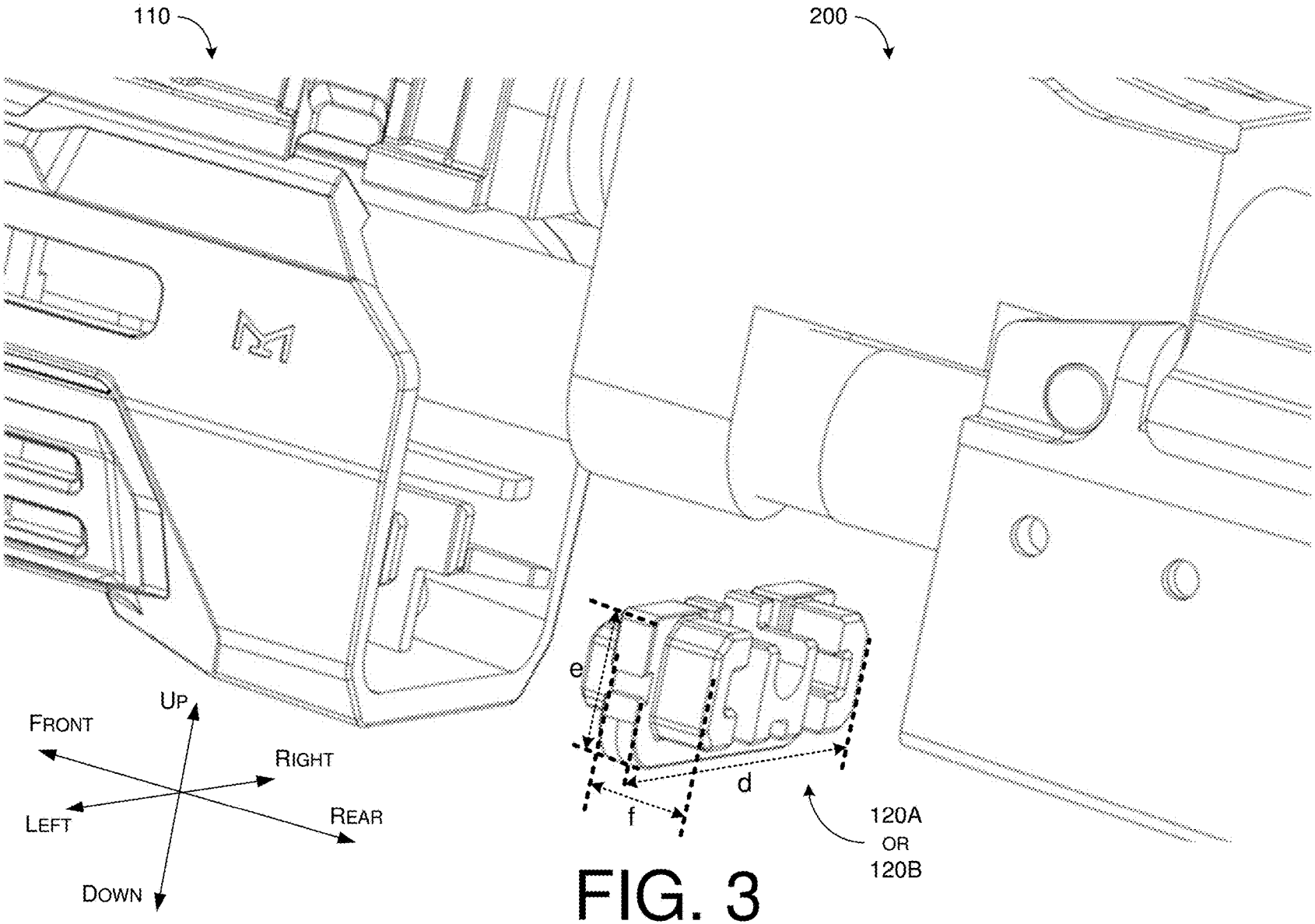
FIG. 3 is a diagram of a first perspective view of the device of FIG. 1 being implemented on a firearm.
Figure 4:
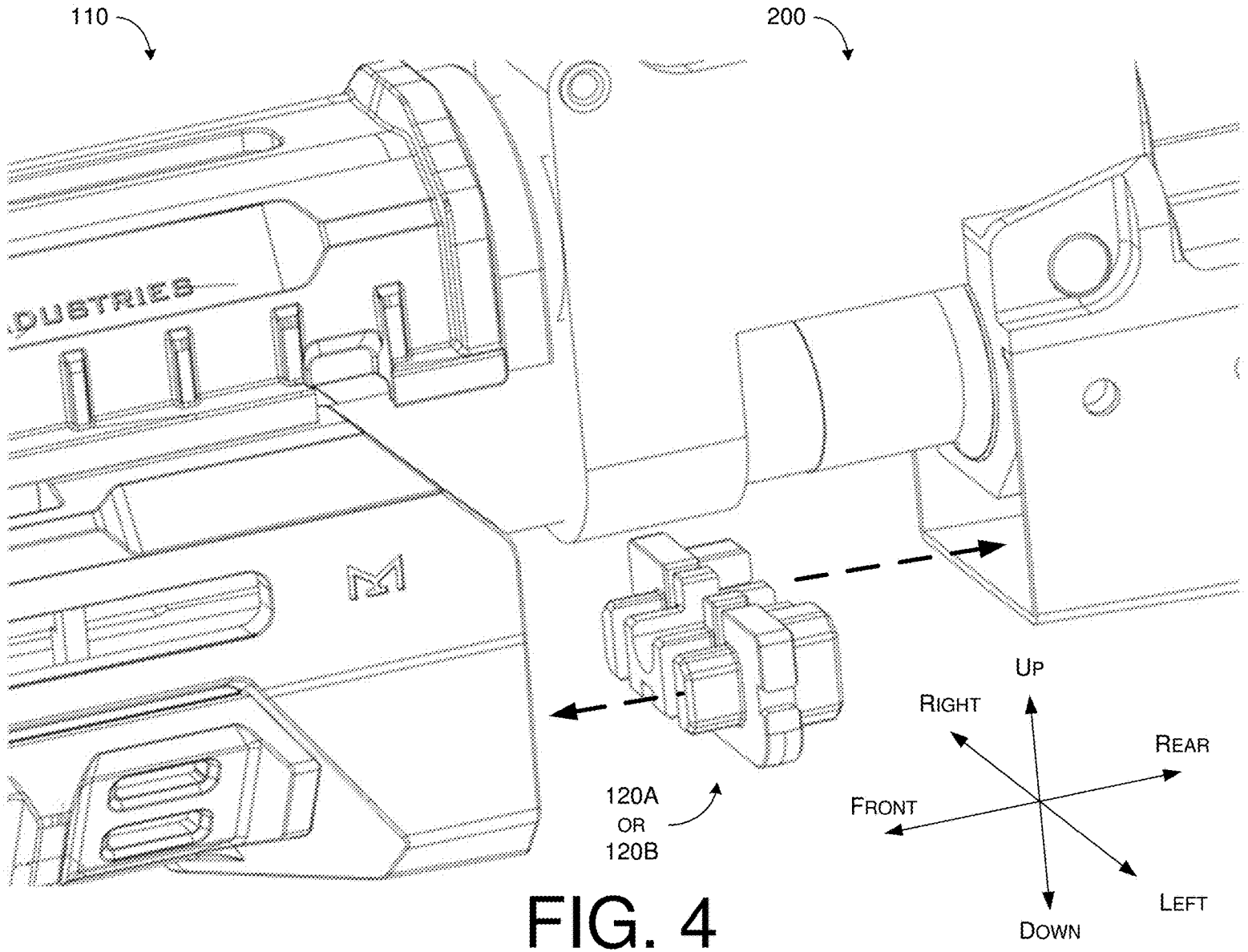
FIG. 4 is a diagram of a second perspective view of the device of FIG. 1 being implemented on a firearm.

Referring to FIG. 3 and FIG. 4, each bridge adapter of the plurality of bridge adapters (e.g., first and second bridge adapters 120A and 120B) may have a first side (e.g., the forward-facing side facing handguard 110) configured to connect to the handguard 110 and a second side (e.g., the rear-facing side facing the receiver of firearm 200) configured to connect to a receiver of the respective firearm on which device 100 is installed. As shown in FIG. 3, each of first and second bridge adapters 120A and 120B may have dimensions 'd', 'e' and 'f' corresponding to dimensions 'a', 'b' and 'c' of a respective firearm for which the bridge adapter is designed. That is, at least one of dimensions 'd', 'e' and 'f' of first bridge adapter 120A may be different from correspondingly at least one of dimensions 'd', 'e' and 'f' of second bridge adapter 120B. Accordingly, first bridge adapter 120A may be configured to connect between handguard 110 and a first firearm having a first receiver with first dimensions (e.g., 'a1', 'b1' and 'c1'), which second bridge adapter 120B may be configured to connect between handguard 110 and a second firearm having a second receiver with second dimensions (e.g., 'a2', 'b2' and 'c2') that are different from the first dimensions (e.g., at least one of 'a1', 'b2' and 'c1' may be different from corresponding at least one of 'a2', 'b2' and 'c2'). Advantageously, such first and second bridge adapters 120A and 120B may allow the handguard 110 to be installed on at least two different firearms having receivers of different dimensions so that the handguard 110 may at least partially surround a barrel of the respective firearm on which the device 100 is installed.

Under a proposed design, a material of handguard 110 may include metal, polymer and/or wood. Similarly, a material of at least one of the first and second bridge adapters 120A/120B may include metal, polymer and/or wood.

Figure 5:
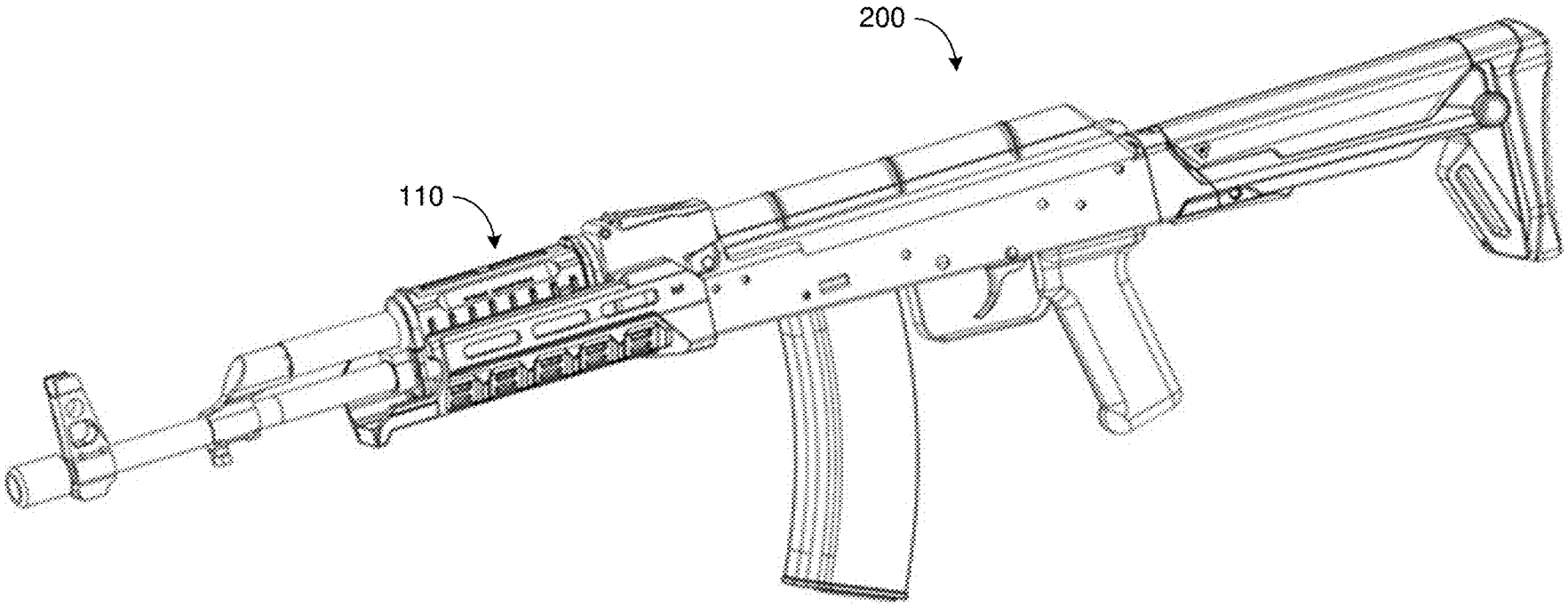
FIG. 5 is a diagram of an example firearm with the device of FIG. 1 implemented thereon.

Referring to FIG. 5, device 100 may be installed on different firearms having receivers (or upper receivers) with different dimensions 'a', 'b' and 'c'. The different firearms may include AR-style firearms as well as AK-style firearms. For instance, each of first and second bridge adapters 120A and 120B may be configured to connect between handguard 110 and different AK-style firearms when device 100 is installed on each of the different AK-style firearms. In such cases, at least two of the different AK-style firearms may have receivers with different dimensions. Likewise, each of first and second bridge adapters 120A and 120B may be configured to connect between handguard 110 and different AR-style firearms when device 100 is installed on each of the different AR-style firearms. In such cases, at least two of the different AR-style firearms may have receivers with different dimensions.

Highlight of Select Features

In view of the above, select features of various implementations in accordance with the present disclosure are highlighted below.

In one aspect, a device implementable on a plurality of firearms (e.g., AR-style or AK-style rifles, carbines, pistols or shotguns) may include a handguard and at least first and second adapters. The handguard may be of a fixed size. The first and second adapters may have different sizes, and each of the first and second adapters may be configured to couple between the handguard and a receiver of a respective one of at least two different firearms of the plurality of firearms having receivers of different dimensions. Advantageously, such first and second adapters may allow the handguard to be installed on at least two different firearms having receivers of different dimensions so that the handguard may at least partially surround a barrel of the respective firearm on which the device is installed.

In some implementations, at least one of a width, a height and a length of the first adapter may be different from a respective width, height or length of the second adapter.

In some implementations, a material of the handguard may include metal, polymer and/or wood.

In some implementations, a material of at least one of the first and second adapters may include metal, polymer and/or wood.

In some implementations, each adapter of the first and second adapters may be configured to connect between the handguard and different AK-style firearms when the device is installed on each of the different AK-style firearms. In such cases, at least two of the different AK-style firearms may have receivers with different dimensions.

In some implementations, each adapter of the first and second adapters may be configured to connect between the handguard and different AR-style firearms when the device is installed on each of the different AR-style firearms. In such cases, at least two of the different AR-style firearms may have receivers with different dimensions.

In another aspect, a device implementable on a plurality of firearms (e.g., AR-style or AK-style rifles, carbines, pistols or shotguns) may include a handguard and a plurality of adapters. The handguard may be configured to at least partially surround a barrel of each firearm of the plurality of firearms when the device is installed on a respective firearm of the plurality of firearms. Each adapter of the plurality of adapters may have a first side configured to connect to the handguard and a second side configured to connect to a receiver of the respective firearm when the device is installed on the respective firearm such that: (a) a first adapter of the plurality of adapters is configured to connect between the handguard and a first firearm of the plurality of firearms having a first receiver with first dimensions, and (b) a second adapter of the plurality of adapters is configured to connect between the handguard and a second firearm of the plurality of firearms having a second receiver with second dimensions that are different from the first dimensions.

In some implementations, at least one of a width, a height and a length of each adapter of the plurality of adapters may be different from a respective width, height or length of other adaptors of the plurality of adapters.

In some implementations, a material of the handguard may include metal, polymer and/or wood.

In some implementations, a material of at least one of the plurality of adapters may include metal, polymer and/or wood.

In some implementations, each adapter of the plurality of adapters may be configured to connect between the handguard and different AK-style firearms when the device is installed on each of the different AK-style firearms. In such cases, at least two of the different AK-style firearms may have receivers with different dimensions.

In some implementations, each adapter of the plurality of adapters may be configured to connect between the handguard and different AR-style firearms when the device is installed on each of the different AR-style firearms. In such cases, at least two of the different AR-style firearms may have receivers with different dimensions.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a plurality of firearms, comprising:

a handguard of a fixed size; and at least first and second adapters having different sizes and each configured to couple between the handguard and a receiver of a respective one of at least two different firearms of the plurality of firearms having receivers of different dimensions.

2. The device of claim 1, wherein at least one of a width, a height and a length of the first adapter is different from a respective width, height or length of the second adapter.

3. The device of claim 1, wherein a material of the handguard comprises metal.

4. The device of claim 1, wherein a material of the handguard comprises polymer.

5. The device of claim 1, wherein a material of the handguard comprises wood.

6. The device of claim 1, wherein a material of at least one of the first and second adapters comprises metal.

7. The device of claim 1, wherein a material of at least one of the first and second adapters comprises polymer.

8. The device of claim 1, wherein a material of at least one of the first and second adapters comprises wood.

9. The device of claim 1, wherein each adapter of the first and second adapters is configured to connect between the handguard and different AK-style firearms when the device is installed on each of the different AK-style firearms, and wherein at least two of the different AK-style firearms have receivers with different dimensions.

10. The device of claim 1, wherein each adapter of the first and second adapters is configured to connect between the handguard and different AR-style firearms when the device is installed on each of the different AR-style firearms, and wherein at least two of the different AR-style firearms have receivers with different dimensions.

11. A device implementable on a plurality of firearms, comprising:

a handguard configured to at least partially surround a barrel of each firearm of the plurality of firearms when the device is installed on a respective firearm of the plurality of firearms; and a plurality of adapters with each adapter of the plurality of adapters having a first side configured to connect to the handguard and a second side configured to connect to a receiver of the respective firearm when the device is installed on the respective firearm, wherein:

a first adapter of the plurality of adapters is configured to connect between the handguard and a first firearm of the plurality of firearms having a first receiver with first dimensions, and a second adapter of the plurality of adapters is configured to connect between the handguard and a second firearm of the plurality of firearms having a second receiver with second dimensions that are different from the first dimensions.

12. The device of claim 11, wherein at least one of a width, a height and a length of each adapter of the plurality of adapters is different from a respective width, height or length of other adaptors of the plurality of adapters.

13. The device of claim 11, wherein a material of the handguard comprises metal.

14. The device of claim 11, wherein a material of the handguard comprises polymer.

15. The device of claim 11, wherein a material of the handguard comprises wood.

16. The device of claim 11, wherein a material of at least one of the plurality of adapters comprises metal.

17. The device of claim 11, wherein a material of at least one of the plurality of adapters comprises polymer.

18. The device of claim 11, wherein a material of at least one of the plurality of adapters comprises wood.

19. The device of claim 11, wherein each adapter of the plurality of adapters is configured to connect between the handguard and different AK-style firearms when the device is installed on each of the different AK-style firearms, and wherein at least two of the different AK-style firearms have receivers with different dimensions.

20. The device of claim 11, wherein each adapter of the plurality of adapters is configured to connect between the handguard and different AR-style firearms when the device is installed on each of the different AR-style firearms, and wherein at least two of the different AR-style firearms have receivers with different dimensions.

* * * * *